United States Patent [19]

Dupre et al.

[11] 3,951,180

[45] Apr. 20, 1976

[54] LOOM SHUTTLE

[75] Inventors: Marcel J. Dupre, Bellingham; Walter C. Webster, Northbridge, both of Mass.

[73] Assignee: Rockwell International Corporation, Pittsburgh, Pa.

[22] Filed: May 19, 1975

[21] Appl. No.: 578,468

[52] U.S. Cl. ..... 139/196.1

[51] Int. Cl.[2] ..... D03J 5/00

[58] Field of Search ..... 139/196 R, 197, 217–223; 260/72

[56] References Cited

UNITED STATES PATENTS

| | | | |
|---|---|---|---|
| 2,335,564 | 11/1943 | Ellis | 139/223 X |
| 2,717,616 | 9/1955 | Gosselin | 139/223 |
| 2,720,224 | 10/1955 | Neely | 139/196 R |
| 2,781,791 | 2/1957 | Neely | 139/196 R |
| 3,021,307 | 2/1962 | Csendes et al. | 260/72 |

FOREIGN PATENTS OR APPLICATIONS

| | | | |
|---|---|---|---|
| 767,030 | 1/1957 | United Kingdom | 139/196 R |

*Primary Examiner*—James Kee Chi

[57] ABSTRACT

A loom shuttle having a shuttle eye cavity into which an elastomeric material is introduced and then formed to the configuration of a shuttle eye to provide a cushion fit for the latter when assembled within the cavity.

2 Claims, 7 Drawing Figures

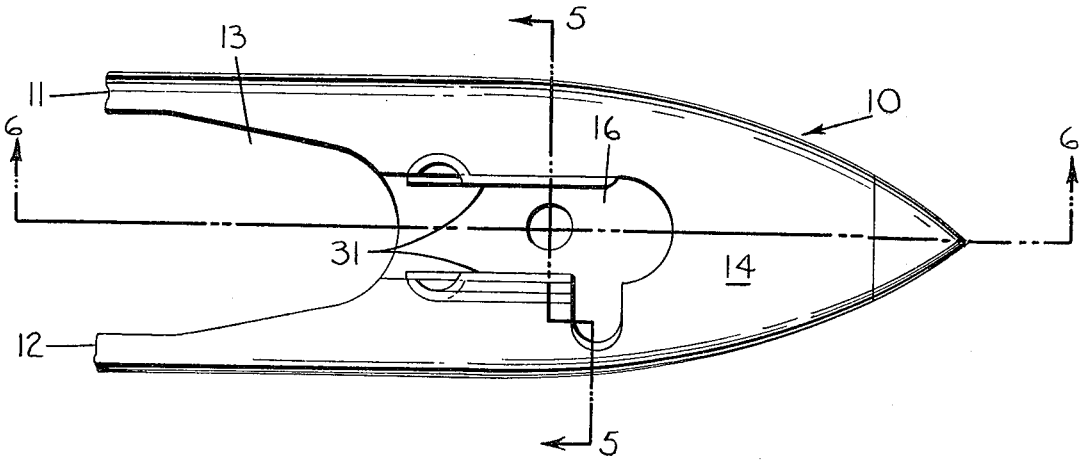
FIG. 4
FIG. 7
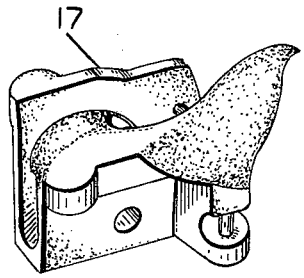
FIG. 5
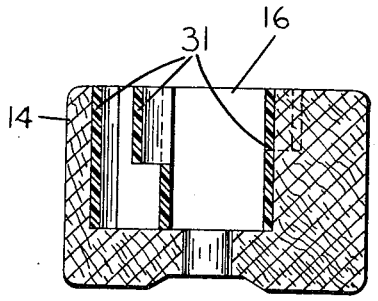
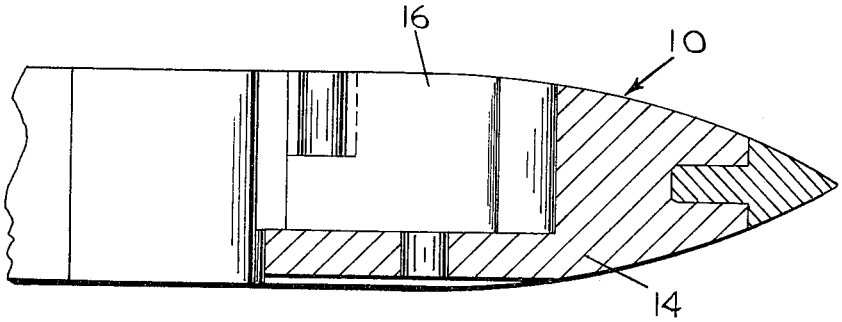
FIG. 6

LOOM SHUTTLE

BACKGROUND OF THE INVENTION

1. Field of the Invention

The invention pertains to looms of the fly-shuttle type in which the supply of weft yarn, to be inserted as picks in sheds of warp threads, is carried by the shuttle itself as the latter is picked back and forth across the width of the loom. More particularly the invention pertains to an improved shuttle for use in such looms in which the well-known shuttle eye assembled in the shuttle is provided with a cushion fit in said shuttle.

This feature permits and simplifies the interchangeability of shuttle eyes in a shuttle and substantially decreases manufacturing losses of both shuttles and shuttle eyes.

2. Description of the Prior Art

The more common form of shuttle eye utilized in loom shuttles is that of the cast type. Cast type shuttle eyes have been the cause of undesirable manufacturing problems as well as complaints from weaving mills of not being able to readily interchange or replace the eyes of their shuttles.

The manufacturing problems are a result of not being able to constantly maintain the shuttle eye castings within predetermined and desired size limitations. The size variations which result in the casting of a shuttle eye frequently result in castings being oversize or undersize which in either event will not permit them to be assembled in the machined shuttle eye cavity formed in one end of a shuttle.

Undersize castings cannot be corrected and results in what a foundry considers a high scrap loss.

Oversize castings coupled with a variation in the machined shuttle eye cavity in a shuttle have been the cause, during assembly of a shuttle eye, in the splitting of the shuttle eye and in some cases the reworking of a shuttle for the proper assembly of an eye within its cavity. The reworking of a shuttle and a shuttle eye, results in what is termed selective assembly, or in other words several shuttle eyes may be tried in a particular shuttle before finding one which fits satisfactorily. Selective assembly of shuttle eyes eliminates the possibility of weaving mills to interchange shuttle eyes and of course is the basis for their complaints relative thereto.

The improved loom shuttle comprising the invention provides a cashion fit for the shuttle eye when assembled in a shuttle and provides the means whereby weaving mills can now interchange their shuttle eyes. Additionally the invention will permit shuttle eye castings to be used having as much as thirty thousandths variation, the need for reworking the eyes has been eliminated, and foundry losses have been reduced to a minimum.

SUMMARY OF THE INVENTION

The loom shuttle of the present invention is provided with a shuttle eye cut or cavity that is machined to predetermined oversize dimensions into which an elastomeric material in liquid form, such as polyurethane is placed. The shuttle is fixed on a jig plate and a heated metal plug having a configuration conforming to the shape of the shuttle eye is pressed into the cavity where it displaces the elastomeric material so as to leave a predetermined amount of said material between the plug and the cavity wall. The plug is then withdrawn from the cavity and the elastomeric material allowed to cure thereby forming a resilient seat into which a shuttle eye is adapted to assemble.

It is a general object of the invention to provide a loom shuttle in which shuttle eyes are readily interchangeable.

Another object is to provide a loom shuttle which does not require the reworking of a shuttle eye cavity or shuttle eye prior to assembly.

A further object is to provide a loom shuttle into which shuttle eyes having a greater range of casting variations can be satisfactorily assembled.

These and other objects of the present invention will become more fully apparent by reference to the appended claims and as the following detailed description proceeds in reference to the figures of drawing wherein:

BRIEF DESCRIPTION OF THE DRAWING

FIG. 4 is a top view of a portion of a loom shuttle showing those surfaces of the cavitie's side walls to which the elastomeric material is applied, FIG. 5 is a sectional view of the shuttle taken along line 5—5 in FIG. 4, FIG. 6 is a sectional view of the shuttle taken along line 6—6 in FIG. 4, and FIG. 7 is a perspective view of a shuttle eye adapted to assemble in the shuttle eye cavity of the shuttle.

DESCRIPTION OF THE PREFERRED EMBODIMENT

Now referring to the figures of drawing enough of a loom shuttle is shown in the various figures of drawing to serve as a basis for a detailed description of the invention applied thereto.

Figure 1:
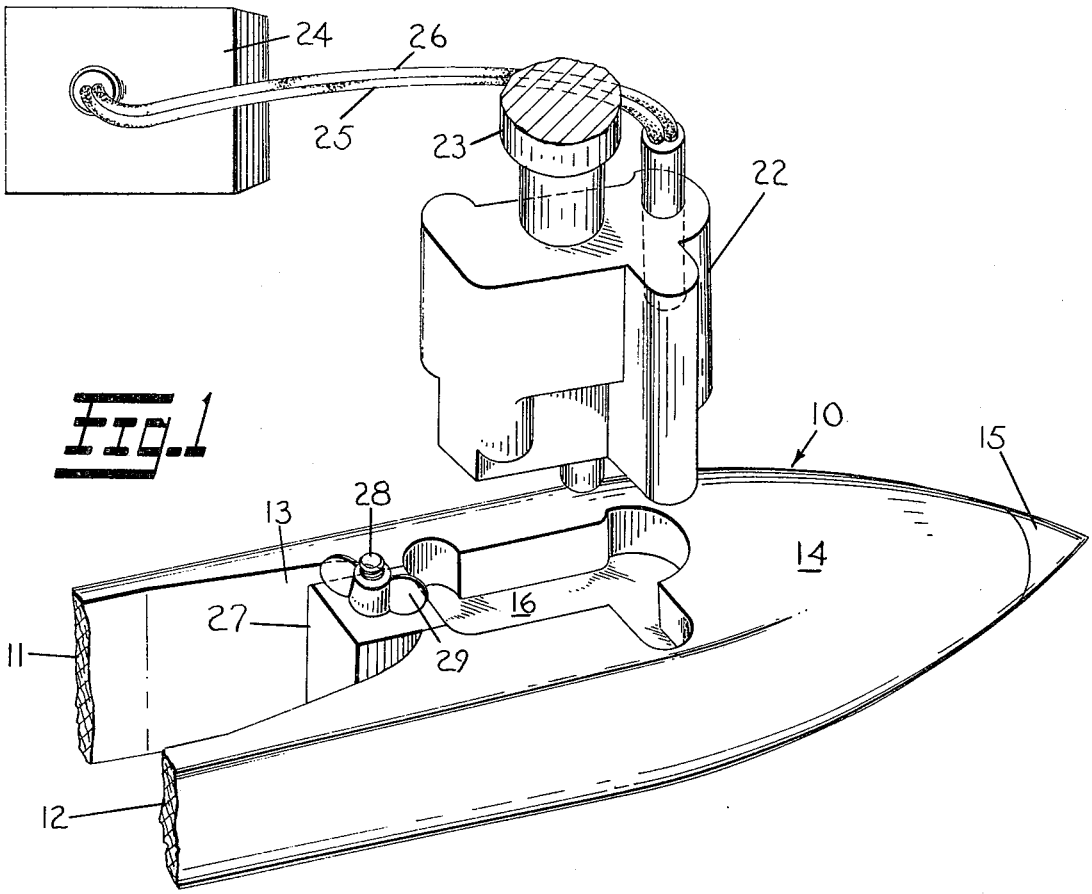
FIG. 1 is a perspective view of a portion of a loom shuttle showing the device for forming a cushion fit for a shuttle eye in the shuttle eye cavity.

In FIG. 1 a portion of a loom shuttle is identified generally by numeral 10 and includes spaced side walls 11 and 12 which defines a bobbin cavity 13 therebetween.

Side walls 11 and 12 interconnect with the end members of a shuttle one of which is shown identified in FIGS. 1, 2, 4 and 6 by numeral 14. Those end members have the usual tips or so-called shuttle spurs 15 fixed therein and serve a purpose well-known to those conversant in the weaving art.

A shuttle eye cut or cavity 16 is machined in end member 14 and is adapted to have a shuttle eye 17 (FIG. 7) assembled therein.

The means for providing a cushion fit for the shuttle eye 17 when it is assembled in the cavity 16 will now be described.

Figure 2:
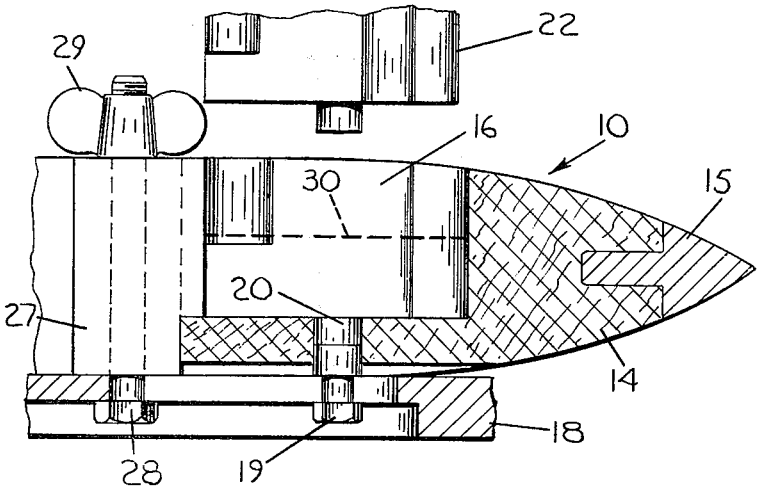
FIG. 2 is a view in side elevation and partially in section showing a portion of the fixture for positioning a shuttle and a portion of the metal plug for displacing the elastomeric material within the shuttle eye cavity.

As shown in FIG. 2 the shuttle is mounted in a fixed position on a jig plate 18 and is located thereon in a predetermined position by means of a locating screw 19 temporarily carried for that purpose in a hole 20 formed in the end member 14 which communicates with both the cavity 16 and the underside of the shuttle 10.

A metal plug or die 22 having a configuration which conforms to the shape of a shuttle eye is carried for vertical movement on the lower end of a mandrel 23 of a suitable press (not shown). This die is disposed in vertical alignment with the position assumed by the cavity 16 when the shuttle is mounted on the jig plate 18 and is movable into out of said cavity for the purpose yet to be described.

The walls of the cavity are lined with a durable resilient material having a short A hardness of 60 to 80 and polyurethane elastomers are one example of a polymer which will meet these requirements. The material may consist of a methylene phenylene diisocyanate prepolymer as one component mixed with a second component of various polyols. To decrease cure time heat is applied and catalysts are added (Dibutyltindilourate and Stannous Octoate).

Heat is furnished to the die 22 from any suitable heat control source which is identified in FIG. 1 by numeral 24 and is connected to said die by electrical leads 25 and 26.

One side of the cavity 16 communicates with the bobbin cavity 13 and to close the opening interconnecting the two cavities while lining the shuttle eye cavity a retaining block 27 is provided which assembles to the jig plate 18 by means of a bolt 28 and a wing nut 29.

Figure 3:
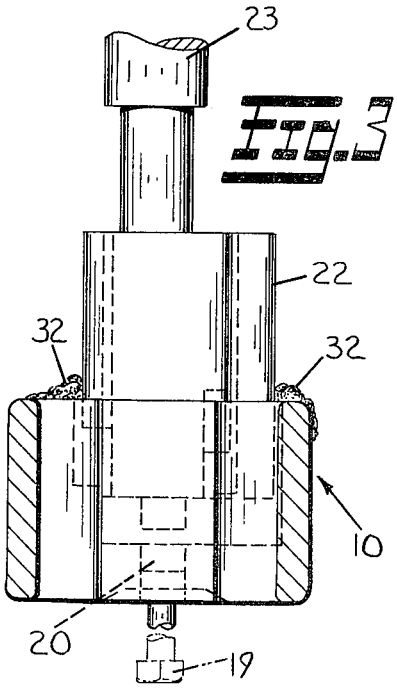
FIG. 3 is an end view of a shuttle and partially in section showing the metal plug pressed into the shuttle eye cavity.

To summarize the operation the elastomeric material as a viscous liquid can be either poured or injected into the shuttle eye cavity to the approximate level of the dotted line 30 in FIG. 2. The die 22 is then heated to a predetermined temperature and the press actuated so as to lower the die into the shuttle eye cavity 16. The die displaces the elastomeric material in the shuttle eye cavity so that it lines certain walls with said material as indicated by numeral 31 in FIGS. 4 and 5 and prevents said material from attaching itself to other surfaces of said cavity. The die being heated when entering the cavity 16 causes the elastomeric material to cure in a relatively short period of time, and the excess material that is forced out of the cavity during the lowering of the die 22 therein is identified in FIG. 3 by numeral 32. This excess material is disgarded upon withdrawal of the die 22 and upon completion of the curing time required by said material a shuttle eye can be assembled in the cavity 16.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A shuttle for looms comprising:

a. side and end members defining a bobbin cavity therebetween;

b. a shuttle eye;

c. means defining a cavity in one of said end members to receive said shuttle eye; and d. elastomeric means contained within said cavity to receive said shuttle eye to provide a cushion fit therefor and to permit said shuttle eye to be interchanged when desired.

2. The shuttle according to claim 1 wherein said elastomeric means defines a lining of polyurethane in said shuttle eye cavity.

* * * * *